US005094387A

United States Patent [19]

Rice et al.

[11] Patent Number: 5,094,387

[45] Date of Patent: Mar. 10, 1992

[54] ADJUSTABLE HOOK FLANGE GUARD RAIL FOR USE ON TRACKWORK

[75] Inventors: Paul P. Rice, Harrisburg; Frank P. Bobb, Camp Hill, both of Pa.

[73] Assignee: Bethlehem Steel Corporation, Bethlehem, Pa.

[21] Appl. No.: 679,881

[22] Filed: Apr. 3, 1991

[51] Int. Cl.[5] ..... E01B 9/60

[52] U.S. Cl. ..... 238/23; 238/292

[58] Field of Search ..... 238/17, 18, 19, 20, 238/21, 22, 23, 122, 149, 292

[56] References Cited

U.S. PATENT DOCUMENTS

| | | | |
|---|---|---|---|
| 536,134 | 3/1895 | Cummins | 238/23 |
| 843,897 | 2/1907 | Korns | 238/23 |
| 853,254 | 5/1907 | Miller | 238/23 |
| 1,501,319 | 7/1924 | Dooley | 238/336 |
| 2,475,116 | 7/1949 | Vickroy | 238/336 |
| 2,515,678 | 7/1950 | Vickroy | 238/292 |
| 2,597,697 | 5/1952 | Asselin | 238/23 X |
| 2,904,256 | 9/1959 | Devaney, Jr. | 238/336 |
| 3,053,456 | 9/1962 | Reider | 238/23 |
| 3,292,857 | 12/1966 | Hughes | 238/292 |
| 4,193,544 | 3/1980 | Marchant et al. | 238/336 |
| 4,566,630 | 1/1986 | Keiper | 238/292 |
| 4,770,342 | 9/1988 | Farrell et al. | 238/347 |
| 4,967,954 | 11/1990 | Lange | 238/310 |

OTHER PUBLICATIONS

FIG. 3813 on p. 53 of an Abex Corporation—Racor Trackwork Catalog No. G-5 showing a Racor Heavy Duty Guard Rail Clamp.

Pages 217 and 218 of a Bethlehem Steel Corporation 1946 Steel Products Catalog showing the Bethlehem Hook Flange Guard Rail.

*Primary Examiner*—Frank E. Werner
*Assistant Examiner*—James Eller
*Attorney, Agent, or Firm*—Harold I. Masteller, Jr.

[57] ABSTRACT

An adjustable hook flange guard rail assembly for use on trackwork including a guard rail, a plurality of tie plates having first and second recessed surfaces for receiving the base portions of rails and the hook flange of a guard rail, a plurality of adjustable chocks, each adjustable chock comprising a first and a second wedge shaped block and, a device for attaching the adjustable chock to the guard rail.

7 Claims, 3 Drawing Sheets

ADJUSTABLE HOOK FLANGE GUARD RAIL FOR USE ON TRACKWORK

BACKGROUND OF THE INVENTION

Hook flange guard rails were originally designed to simplify the installation and maintenance of guard rails along trackwork. Unlike other guard rails, a hook flange guard rail is made up of a rolled steel rail section having one of its two flanges lowered to form a hook which fits beneath the base of an adjacent running rail. As shown in a 1946 Bethlehem Steel catalog entitled "Steel Products", page 218, such hook flange guard rails are held in place by placing the hook flange under the base of an adjacent running rail and wedging the opposite flange against shoulders provided on tie plates.

Anchoring the hook flange under the adjacent running rail utilizes the weight of the rolling stock to prevent overturning of the guard rail due to side thrust forces. This inherent resistance to overturning, which eliminates the need for using rail braces and clamps, has made the hook flange guard rail extremely popular within the industry. However, past practice has failed to provide means for adjusting the distance between a hook flange guard rail and its adjacent running rail. This absence of such lateral adjustment makes it necessary to replace hook flange guard rails at a greater frequency than state-of-the-art adjustable guard rails.

OBJECTS AND SUMMARY OF THE INVENTION

It is therefore an object of this invention to provide adjustment means for moving a hook flange guard rail toward or away from an adjacent running rail.

It is a further object of this invention to provide an adjustable chock for maintaining and adjusting the spaced relationship between a hook flange guard rail and an adjacent running rail.

It is a further object of this invention to provide an adjustable chock capable of being adjusted in cooperation with a boltless type friction rail brace.

It is a still further object of this invention to provide a tie plate having means to enable lateral adjustment of a hook flange guard rail toward or away from an adjacent running rail.

We have discovered that the foregoing objects can be attained by providing a hook flange guard rail assembly comprising a guard rail, a plurality of tie plates having a first recessed surface for receiving the base portions of rails and a second recessed surface for receiving the hook flange portion of a guard rail, a plurality of adjustable chocks, each adjustable chock comprising a first wedge shaped block interlocked with a second wedge shaped block, and means for attaching the adjustable chock to the guard rail.

DETAILED DESCRIPTION OF THE PRESENT EMBODIMENT

Figure 1:
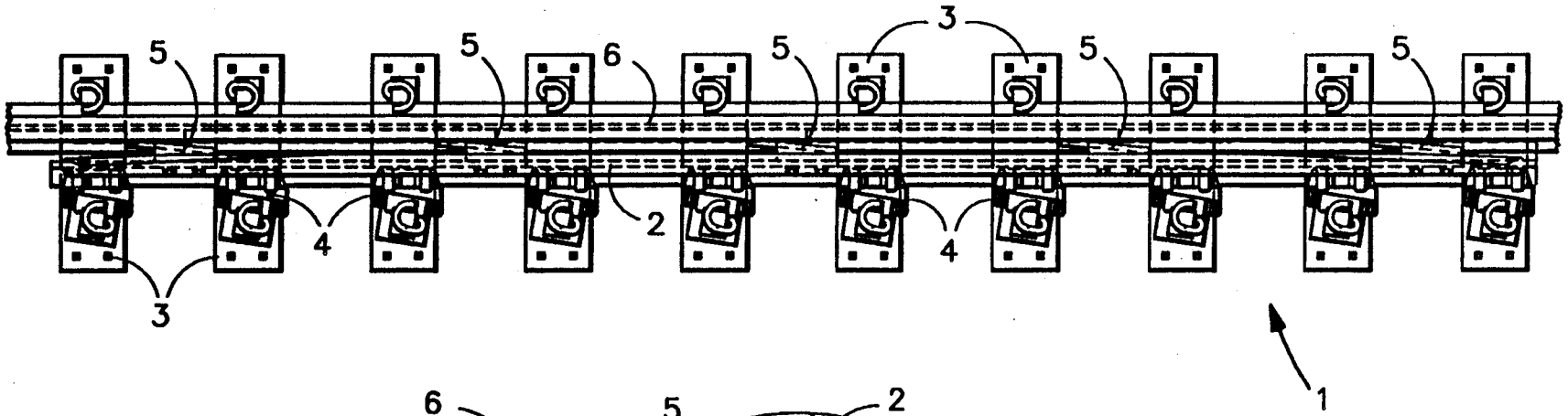
FIG. 1 is a plan view of the preferred embodiment of the invention showing a hook flange guard rail assembly installed adjacent a section of running rail.
Figure 2:
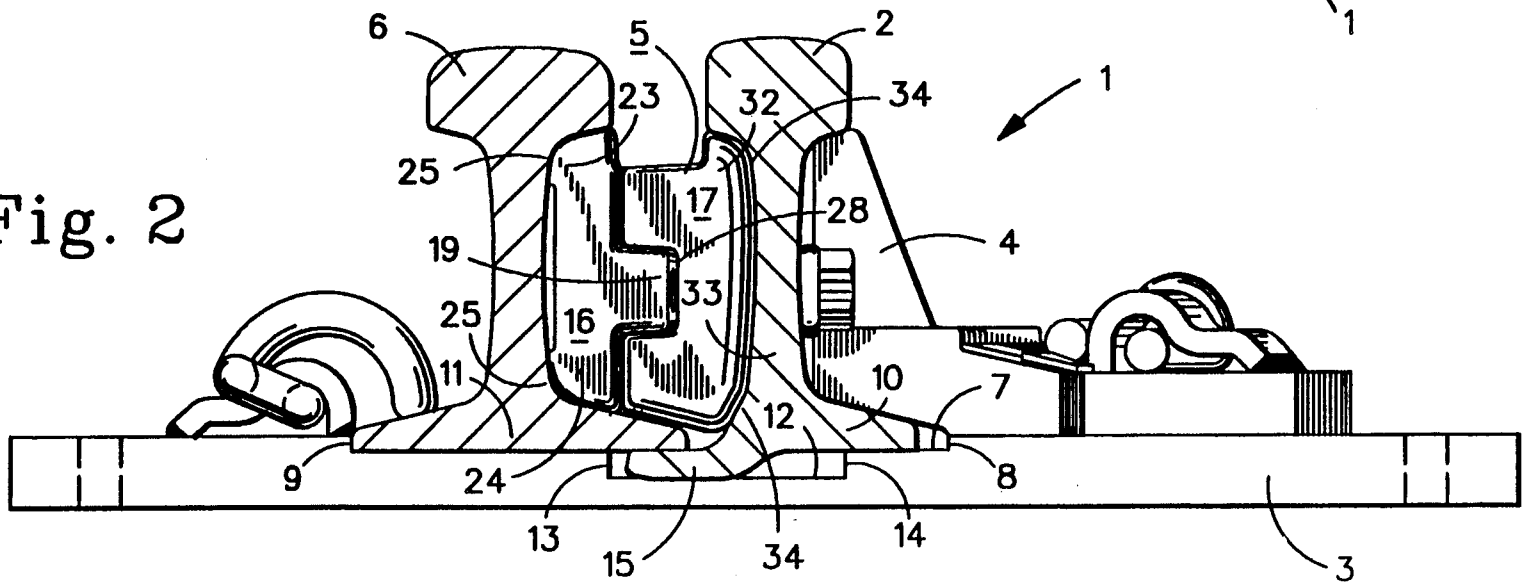
FIG. 2 is a cross-sectional view taken along the lines 2—2 of FIG. 1.

Referring to FIG. 1 of the drawings, a hook flange guard rail assembly 1, comprising an adjustable guard rail 2, tie plates 3, boltless rail braces 4 and adjustable chocks 5, is shown adjacent a section of fixed running rail 6. As shown in more detail in FIG. 2, each tie plate 3 includes a first recessed surface 7, defined by shoulders 8 and 9, for receiving the base portions 10 and 11 of rails 2 and 6. A second recessed surface 12, located between shoulders 8 and 9 of pocket 7 and defined by shoulders 13 and 14, is provided for receiving a hook flange 15 extending from one side of base 10 of guard rail 2.

Figure 5:
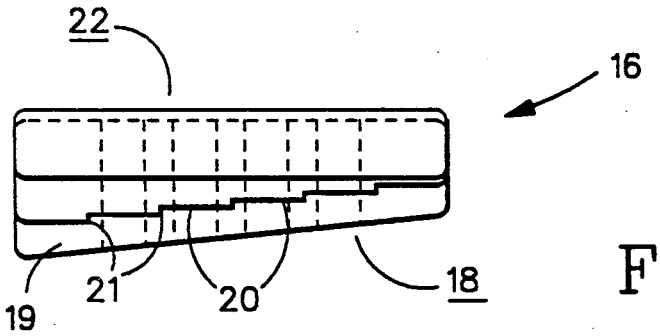
FIG. 5 is a plan view of a wedge shaped block having a tongue.
Figure 6:
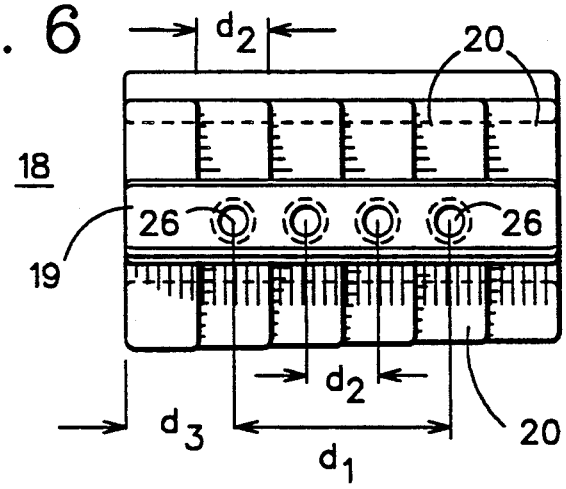
FIG. 6 is a front elevational view of the wedge shaped block shown in FIG. 5.
Figure 7:
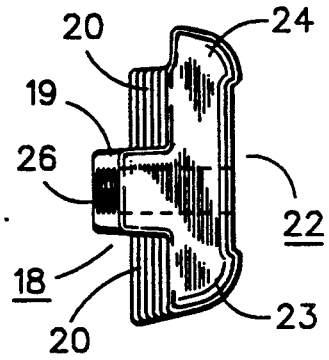
FIG. 7 is a side elevational view of the wedge shaped block shown in FIG. 5.
Figure 8:
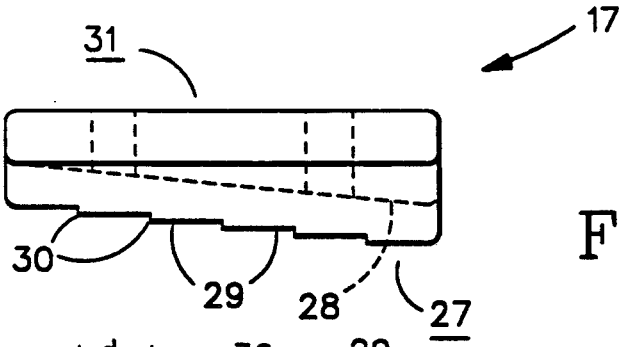
FIG. 8 is a plan view of a wedge shaped block having a groove means.
Figure 9:
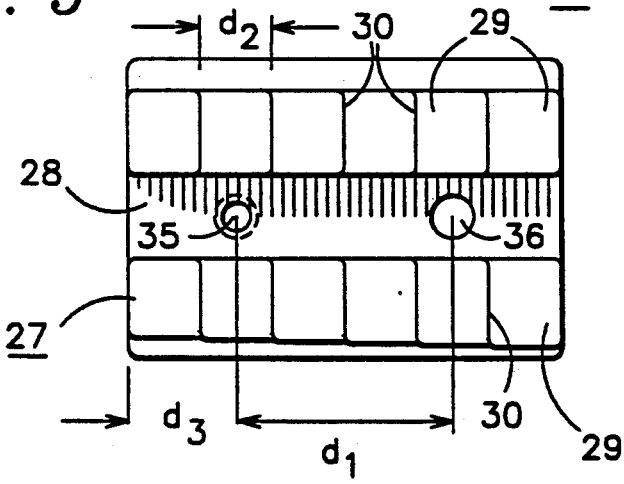
FIG. 9 is a front elevational view of the wedge shaped block shown in FIG. 8.
Figure 10:
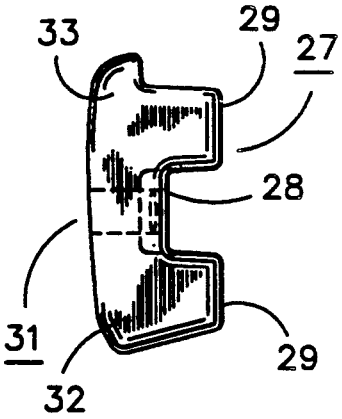
FIG. 10 is a side elevational view of the wedge shaped block shown in FIG. 8.

An adjustable chock 5, inserted between guard rail 2 and running rail 6, governs the distance between the two rails. The adjustable chock 5 comprising a first wedge shaped block 16, shown in FIGS. 5–7, and a second wedge shaped block 17, shown in FIGS. 8–10 of the drawings. Wedge shaped block 16 includes a front surface 18 having a tongue 19 extending therefrom, a plurality of stepped planar surfaces 20 having shoulders 21, and a back surface 22 including a first curved portion 23 and a second curved portion 24 formed to fit within the fillet portions 25 of running rail 6. Front surface 18 is angled toward back surface 22 and a plurality of threaded holes 26, equally spaced along the length of wedge shaped block 16, extend through wedge shaped block 16 from the front surface of tongue 19 to the back surface 22 of wedge shaped block 16. Wedge shaped block 17 includes a front surface 27 having a groove means 28 therein for receiving tongue 19 of wedge shaped block 16, a plurality of stepped planer surfaces 29 and shoulders 30 corresponding to the stepped planer surfaces 20 and shoulders 21 of wedge shaped block 16, and a back surface 31 including a curved surface 32 conforming to the web 33 and fillets 34 of guard rail 2. Wedge shaped block 17 further includes a threaded hole 35 and at least one aperture 36 each of which extends through wedge shaped block 17 from a recessed front surface of groove means 28 to the back surface 31 of wedge shaped block 17.

Figure 4:
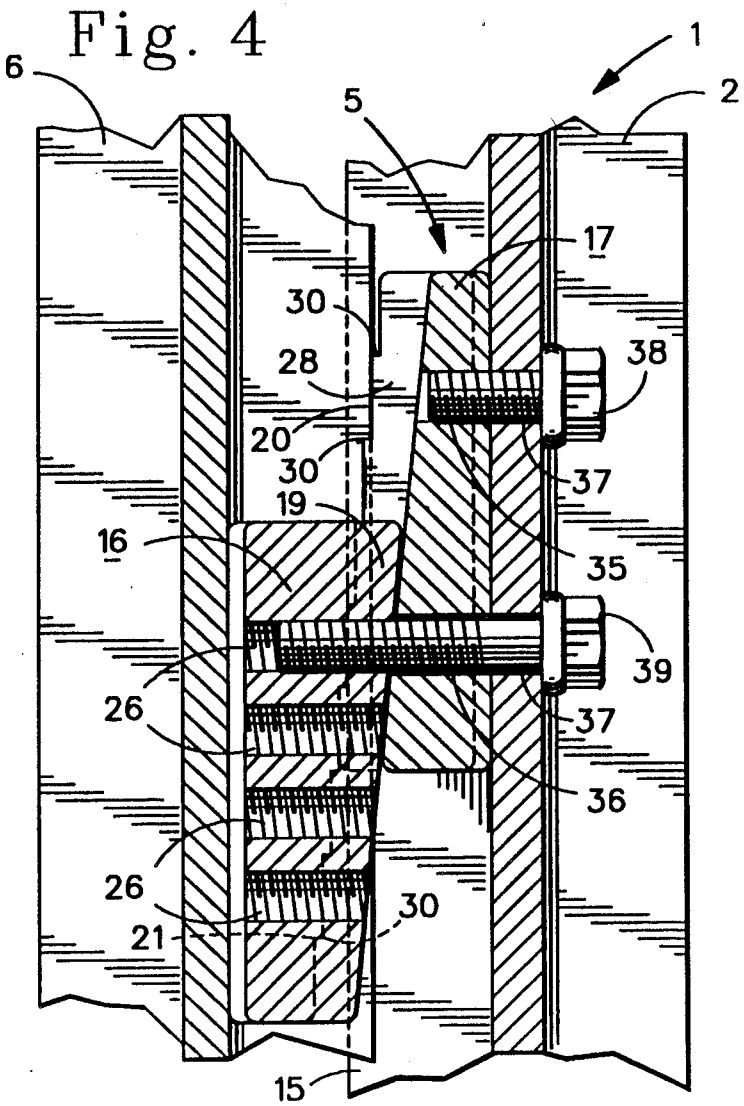
FIG. 4 is a cross-sectional view taken through the webs of the guard rail and running rail showing the maximum adjusted distance between both rails.
Figure 3:
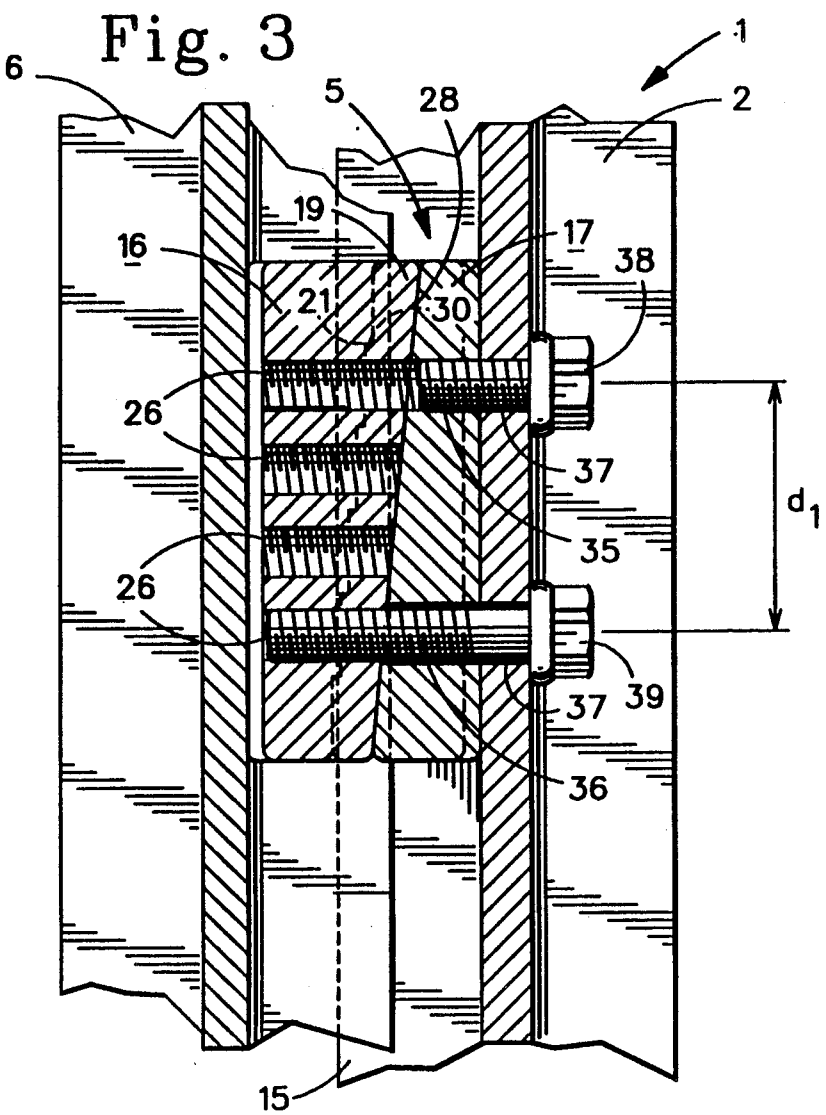
FIG. 3 is a cross-sectional view taken through the webs of the guard rail and running rail showing the minimum adjusted distance between both rails.

The threaded hole 35 and aperture 36 of wedge shaped block 17, and the plurality of equally spaced threaded holes 26 of wedge shaped block 16, as well as shoulders 21 and 30 of both wedge shaped blocks, are arranged to cause aperture 36 to come into alignment with any selected threaded hole 26 when wedge shaped blocks 16 and 17 are interlocked with tongue 19 inserted into groove 28 and shoulders 21 and 30 frictionally engaged against each other as shown in FIGS. 3 and 4 of the drawings. To cause such alignment of aperture 36 with any selected threaded hole 26, threaded hole 35 and aperture 36 are spaced apart along the length of wedge shaped block 17 at a distance defined as $d_1$ which is equal to the center to center distance $d_1$ shown between the first threaded hole 26 and the last threaded hole 26 of wedge shaped block 16, threaded holes 26 are equally spaced along the length of wedge shaped block 16 at a center to center distance defined as $d_2$ which is equal to the shoulder to shoulder distance $d_2$ shown between shoulders 21 and 30 of both wedge shaped blocks, and the first threaded hole 26 of wedge shaped block 16 has an edge distance $d_3$ equal to edge distance $d_3$ of threaded hole 35.

Referring again to FIGS. 3 and 4 of the drawings, spaced apart apertures 37, having a center to center distance $d_1$, are provided within the web of guard rail 2. A first fastener 38 extends through one of the apertures 37 engaging threaded hole 35 and attaching wedge shaped block 17 to guard rail 2. A second fastener 39 also extends through an aperture 37 as well as aperture 36 of wedge shaped block 17, and engages one of the equally spaced threaded holes 26 attaching wedge shaped block 16 to wedge shaped block 17.

Adjustment of the gauge distance between the guard rail 2 and the adjacent running rail 6 is accomplished by fastening wedge shaped block 17 to the web of guard rail 2 with fastener 38. The adjustable chock 5 is set to a suitable gauge distance by interlocking wedge shaped blocks 16 and 17 with their tongue and groove means 19 and 28 aligning the appropriate threaded hole 26 with aperture 36 and bringing corresponding shoulders 21 and 30 into frictional engagement. Wedge shaped block 16 is fastened to wedge shaped block 17 by inserting fastener 39 through apertures 37 and 36 and engaging aligned threaded hole 26. Keeping the hook flange 15 of guard rail 2 seated within pocket 12 of tie plate 3 and keeping base portion 10 seated within pocket 7, the guard rail 2 is forced toward the adjacent running rail 6 causing the curved portions 24 and 25 of wedge shaped block 16 to bear against fillet portions 25 of running rail 6 while the hook flange 15 to be forced beneath base 11 of the running rail. A boltless rail brace 4 and rail clips are used to constrain the guard rail 2 and force one edge of base 11 against shoulder 9 of tie plates.

While I have described and shown the preferred embodiment of my invention, it should be understood that various other embodiments may be devised within the scope of the invention. For example, $d_2$ may be changed to either increase or decrease the accuracy of chock adjustment, or $d_1$ may be changed to achieve a larger or smaller gauge distance between rails 2 and 6.

We claim:

1. An adjustable hook flange guard rail assembly, comprising:

a) a guard rail including a rail head, a base, a hook flange extending from one side of said base, and a web extending between said rail head and said base, said web including fillets;

b) a fixed rail including a rail head, a base, and a web extending between said rail head and said base, said web including fillets;

c) a plurality of tie plates, each tie plate including a first recessed surface for receiving the base of said guard rail and the base of said fixed rail, said first recessed surface defined by a pair of shoulders and, a second recessed surface for receiving the hook flange of said guard rail, said second recessed surface defined by a pair of shoulders located between the shoulders of said first recessed surface;

d) a plurality of adjustable chocks between said guard rail and said fixed rail, each chock including;

i) a first wedge shaped block having a top portion, a bottom portion, a back surface, a front surface angled toward said back surface, said front surface including a progression of stepped planer surfaces spaced along the length of said first wedge shaped block each said stepped planer surface including one or more shoulders, a groove between said top portion and said bottom portion, said groove extending along the length of said wedge shaped block and including a recessed front surface, a threaded hole extending from said recessed front surface to said back surface of the first wedge shaped block and, an aperture extending from said recessed front surface to said back surface of the first wedge shaped block, ii) a second wedge shaped block having a top portion, a bottom portion, a back surface, a front surface angled toward said back surface, said front surface including a progression of stepped planer surfaces spaced along the length of said second wedge shaped block and corresponding to said stepped planer surfaces of said first wedge shaped block, each said stepped planer surface of said second wedge shaped block including one or more shoulders, a tongue between said top portion and said bottom portion, said tongue extending along the length of said second wedge shaped block and including a front surface and, a plurality of threaded holes spaced along the length of said second wedge shaped block, each said threaded hole extending from said front surface of said tongue to said back surface of the second wedge shaped block;

e) means for fastening said first wedge shaped block to said guard rail;

f) means for fastening said second wedge shaped block to said first wedge shaped block, and g) means for fastening said guard rail and said fixed rail to said tie plates.

2. The invention of claim 1 wherein:

a) the distance between the threaded hole and the aperture of said first wedge shaped block and the first threaded hole and the last threaded hole of said plurality of threaded holes of the second wedge shaped block is $d_1$, b) the distance between the shoulders of the stepped planer surfaces of said first wedge shaped block and said second wedge shaped block and, the distance between adjacent threaded holes of said plurality of threaded holes of the second wedge shaped block is $d_2$, and c) the distance from one end of said first wedge shaped block to said threaded hole and the distance from one end of said second wedge shaped block to said first threaded hole is $d_3$.

3. The invention of claim 1 wherein the back surface of said first wedge shaped block corresponds to the web and fillets of said guard rail.

4. The invention of claim 1 wherein the back surface of said second wedge shaped block includes a first curved portion corresponding to the fillet and the rail head portion of said fixed rail and a second curved portion corresponding to the fillet and the base portion of said fixed rail.

5. The invention of claim 2 wherein said guard rail includes apertures spaced apart at a distance equal to $d_1$.

6. An adjustable chock for use with railway rails, comprising:

a) a first wedge shaped block having a top portion, a bottom portion, a back surface, a front surface angled toward said back surface, said front surface including a progression of stepped planer surfaces spaced along the length of said first wedge shaped block each said stepped planer surface including one or more shoulders, a groove between said top portion and said bottom portion, said groove extending along the length of said wedge shaped block and including a recessed front surface, a threaded hole extending from said recessed front surface to said back surface of the first wedge shaped block and, an aperture extending from said recessed front surface to said back surface of the first wedge shaped block, b) a second wedge shaped block having a top portion, a bottom portion, a back surface, a front surface angled toward said back surface, said front surface including a progression of stepped planer surfaces spaced along the length of said second wedge shaped block and corresponding to said stepped planer surfaces of said first wedge shaped block, each said stepped planer surface of said second wedge shaped block including one or more shoulders, a tongue between said top portion and said bottom portion, said tongue extending along the length of said second wedge shaped block and including a front surface and, a plurality of threaded holes spaced along the length of said second wedge shaped block, each said threaded hole extending from said front surface of said tongue to said back surface of the second wedge shaped block.

7. The invention of claim 6 wherein;

a) the distance between the threaded hole and the aperture of said first wedge shaped block and the first threaded hole and the last threaded hole of said plurality of threaded holes of the second wedge shaped block is $d_1$, b) the distance between the shoulders of the stepped planer surfaces of said first wedge shaped block and said second wedge shaped block and, the distance between adjacent threaded holes of said plurality of threaded holes of the second wedge shaped block is $d_2$, and c) the distance from one end of said first wedge shaped block to said threaded hole and the distance from one end of said second wedge shaped block to said first threaded hole is $d_3$.

* * * * *